United States Patent [19]

White

[11] Patent Number: 4,858,361

[45] Date of Patent: Aug. 22, 1989

[54] DETACHABLE PROTECTIVE COVER FOR A FIREARM

[76] Inventor: Grover W. White, 2641 Robinwood Rd., Gastonia, N.C. 28054

[21] Appl. No.: 251,891

[22] Filed: Sep. 30, 1988

[51] Int. Cl.[4] ..... B65D 65/10

[52] U.S. Cl. ..... 42/96; 206/316.1; 206/317; 206/818; 150/154

[58] Field of Search ..... 150/52 R, 52 K, 154; 206/818, 317, 316; 224/913; 42/96

[56] References Cited

U.S. PATENT DOCUMENTS

| | | | |
|---|---|---|---|
| 35,456 | 6/1862 | Leverich | 42/96 |
| 2,364,340 | 12/1944 | Bogg, Jr. | 150/52 R |
| 2,599,689 | 6/1952 | Brelsford | 150/52 R X |
| 2,639,751 | 5/1953 | Flaherty | 150/52 K |
| 2,872,960 | 2/1959 | Kolpin | 150/52 R |
| 2,932,334 | 4/1960 | Steen | 150/52 R |
| 3,063,184 | 11/1962 | Sukala, Jr. | 150/52 R X |
| 3,574,965 | 4/1971 | Seiger | 42/96 |
| 3,665,990 | 5/1972 | Hefner, Jr. | 150/52 R |
| 4,209,197 | 6/1980 | Fisher | 150/52 K |

FOREIGN PATENT DOCUMENTS

| | | | |
|---|---|---|---|
| 674216 | 11/1963 | Canada | 150/52 K |

*Primary Examiner*—William Price

*Attorney, Agent, or Firm*—Bell, Seltzer, Park & Gibson

[57] ABSTRACT

A detachable cover for a firearm includes a pliant elongate body having longitudinal edge portions adapted to be arranged in overlapping substantially aligned relation to each other so that said body is of tubular configuration. Edge portions include means releasably holding edge portions in overlapping engagement to each other so as to maintain the tubular configuration of the body. The body includes opposed terminal end portions and is dimensioned and adapted for being placed in surrounding relation to the telescopic sight and bolt mechanism of a firearm.

6 Claims, 1 Drawing Sheet

DETACHABLE PROTECTIVE COVER FOR A FIREARM

FIELD OF THE INVENTION

This invention relates to protective covers for firearms and more particularly to a detachable cover for protecting the telescopic sight and bolt mechanism of a firearm.

BACKGROUND OF THE INVENTION

To maintain the effectiveness and safety of firearms, they must be adequately protected from rain, dirt and other environmental hazards. This especially is true with the more sensitive bolt and telescopic sight mechanism of a firearm where often the slightest rust or foreign particle can affect adversely the accuracy of the scope and the performance of the firearm. Thus, not only must the bolt and telescopic sight mechanism of firearms be protected while in storage, but likewise, on hunting trips and other excursions where the firearm is carried through difficult terrain and adverse environments, adequate protection must be supplied.

Some firearm covers provide the needed protection in the critical areas of the scope and bolt mechanism. U.S. Pat. No. 35,456 to Leverich and U.S. Pat. No. 2,932,334 to Steen are examples of such protective covers. However, it is believed that the use of these protective covers are limited since not only are they difficult and unwieldy to handle, but their removal from the firearm is time consuming. Thus, their use is impractical to those hunters who prefer to maintain a protective cover on a firearm at all times during a hunting trip except when the firearm is discharged. For these hunters, the protective cover is removed when game has been spotted. Thus, a protective cover must be adapted for quick, releasable engagement with the firearm to assure that the firearm is ready for sighting and discharge before the game has fled. Preferably, the cover also should be removable with as little noise as possible since the slightest noise in the still of either the woods, marshes or prairies often will alarm even the most unapprehensive game animal.

It is therefore an object of the invention to provide a detachable cover for protecting the telescopic sight and bolt mechanism of a firearm which is detachable from the firearm with minimum time and effort.

It is another object of this invention to provide a detachable cover for protecting the telescopic sight and bolt mechanism of a firearm which is detachable from the firearm while creating minimum noise during removal.

SUMMARY OF THE INVENTION

These and other objects and advantages of the present invention are accomplished by a detachable cover for protecting a firearm which includes a pliant elongate body having first and second longitudinal edge portions adapted to be arranged in overlapping substantially aligned relation to each other so that the body is of tubular configuration. The body has opposed terminal end portions and is dimensioned and adapted for being placed in surrounding relation to the telescopic sight and bolt mechanism of a firearm. Means are positioned along the longitudinal edge portions for releasably holding the edge portions in overlapping engagement with each other so as to maintain the tubular configuration of the body.

In the preferred embodiment, the body is folded upon itself at longitudinal edge portions to define a hem thereat. A first set of elongate magnets are positioned in spaced-apart relation within the hem of the first longitudinal edge portion and a second set of elongate magnets are positioned in spaced-apart relation within the hem of the second longitudinal edge portion, with the distance between adjacent magnets of each set being greater than the elongate length of the magnets. The magnets are positioned so that when longitudinal edge portions are arranged in overlapping relationship to each other, opposite poles from respective first and second sets of magnets are positioned adjacent each other to create attractive forces between magnets of the first set and magnets of the second set and for releasably holding the longitudinal edge portions in overlapping engagement with each other so as to maintain the tubular configuration of the body. A draw string is carried within each hem at each terminal end portion for drawing the terminal end portions into closer engagement with the firearm.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION

Figure 1:
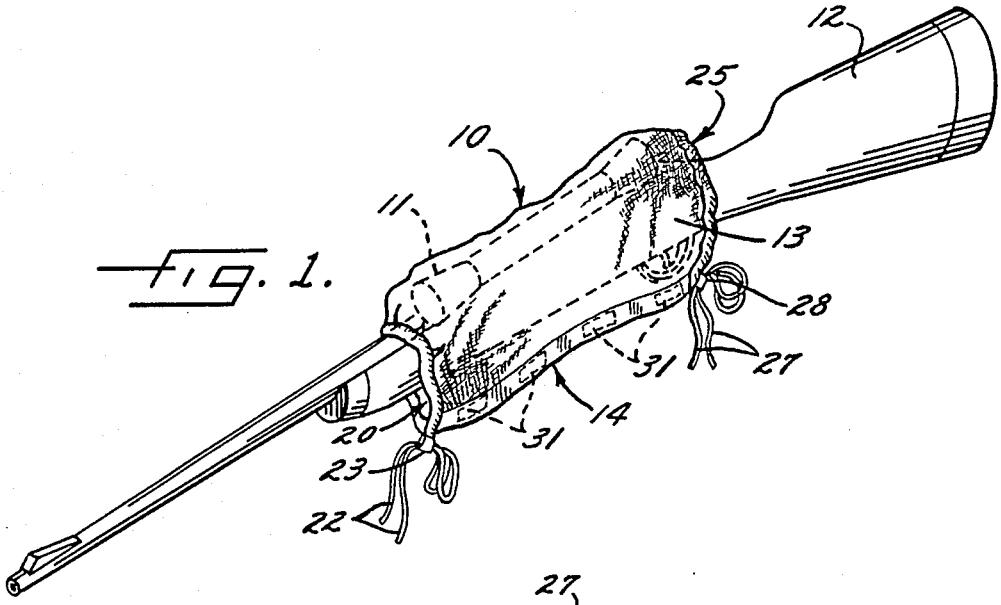
FIG. 1 is an isometric view of a preferred embodiment of the detachable cover applied to a firearm showing the terminal end portions drawn into closer engagement with the firearm by the drawstring.
Figure 2:
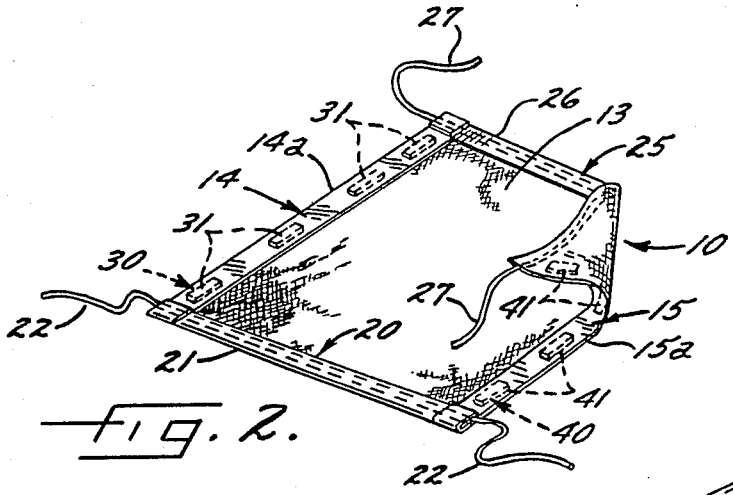
FIG. 2 is an isometric view of the detachable cover removed from a firearm and showing the placement of the magnets and drawstrings.

Referring now specifically to the drawings, and more particularly to FIG. 1, there is shown a preferred embodiment of the detachable cover 10 according to the present invention placed in surrounding relation to the telescopic sight and bolt mechanism 11 of a firearm 12. As best seen in FIG. 2, the cover 10 is made from a pliant, elongate body 13 which preferably is waterproof and provides sufficient cushioning material. Although any pliant, waterproof material can be used, preferably the material is of lightweight construction and exhibits the flexibility and durability mandated by the heavy use accompanying a hunting trip. One material which has been found suitable for use is a lightweight canvas-like woven material commercially sold under the name "Gortex."

In the preferred embodiment, the body 13 is of substantially rectangular configuration and has respective first and second longitudinal edge portions 14, 15 and opposing terminal end portions 20, 25. The body 13 is dimensioned so that it can be placed in surrounding relation to the telescopic sight and bolt mechanism 11 of the firearm 12 with its longitudinal edge portions 14, 15 adapted to be arranged in overlapping substantially aligned relation to each other. In this positioning, the body 13 forms a substantially tubular configuration with the telescopic sight and bolt mechanism 11 of the firearm 12 enclosed by the detachable cover 10.

Positioned along the longitudinal edge portions 14, 15 are means releasably holding the edge portions in overlapping engagement with each other so as to maintain the tubular configuration of the body 13. Preferably the edge portions are releasably held in overlapping engagement in a manner permitting quick and efficient disengagement. During hunting, often game is encountered which is easily alarmed by the sight, sound or smell of a hunter. Unless the cover 10 can be removed quickly, the game often will have fled to an area out of sight or range from the hunter before the cover is removed and the firearm sighted toward the game. In addition, some game pass quickly in and out of firing range especially if the game is foraging for food, shelter or water. Again, a protective cover quickly must be removed and the firearm sighted.

Pile and hook fasteners such as commonly sold under the mark "Velcro" offer one type of fastener which is simple and can be quickly disengaged. When secured along the longitudinal edge portions 14, 15, the pile and hook fasteners provide sufficient force to releasably hold the edge portions in overlapping engagement with each other. When game is sighted, one edge portion can be quickly pulled away from the other edge portion and the cover removed. However, the disengagement of pile and hook fasteners often is noisy so that at shorter hunting distances often encountered when hunting from a deer stand, the game will be alarmed by the noise emanating from the disengaging pile and hook fasteners and flee therefrom.

Figure 4:
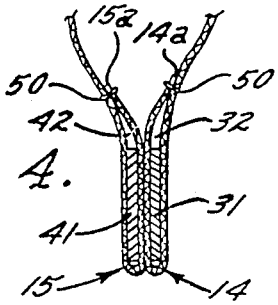
FIG. 4 is a sectional view of the detachable cover taken along line 4—4 of FIG. 1 showing adjacent, overlapping relationship of the magnets.

This problem is solved by the preferred embodiment of the present invention which has first and second sets 30, 40 of elongate magnets positioned along respective first and second longitudinal edge portions 14, 15 to provide magnetic forces attracting edge portions toward each other. In the illustrated embodiment, each set 30, 40 includes a set of four individual magnets 31, 41. To maintain the magnets 31, 41 in their desired position along the longitudinal edge portions 14, 15, each of the edge portions are folded upon themselves to define hems 32, 42 thereat so as to form an envelope to receive the magnets 31, 41 therein (FIG. 4). In the illustrated embodiment, suitable stitching 50 is shown interconnecting the longitudinal edges **14*a*, 15*a* with the body 13 of the protective cover 10 to prevent the hems 32, 42 from unraveling. However, suitable adhesive or other means also can be used to secure the longitudinal edges 14*a*, 15*a*** to the body.

Figure 3:
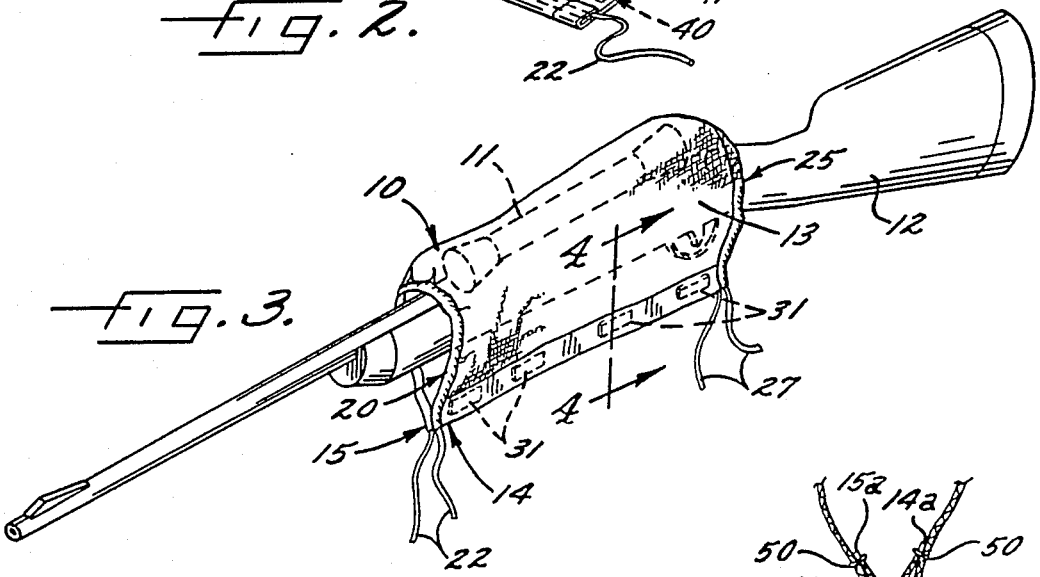
FIG. 3 is an isometric view of the detachable cover applied to a firearm showing loosened drawstrings to prepare the cover for ready removal.

As best illustrated in FIGS. 1, 3 and 4, each of the magnets 31, 41 in each set 30, 40 are of substantially planar and rectangular configuration and can be secured in a desired position within the hems 32, 42 by suitable stitching, adhesive or other means. A substantially planar magnet configuration is preferred since larger magnets not only may detract from the physical appearance and aesthetics of the protective cover 10, but larger magnets can weaken the integrity of the hems.

As illustrated, each set of magnets 30, 40 is positioned within the respective hems 32, 42 with the distance between adjacent magnets 31, 41 of each set being at least greater than the elongate length of the magnets. As will be explained in detail hereafter, the spacing facilitates quiet and quick removal of the protective cover 10 from the firearm 12. In addition, both sets of magnets 30, 40 are positioned so that when longitudinal edge portions 14, 15 of the body 13 are arranged in overlapping relationship to each other, opposite magnetic poles (not shown) from respective first and second sets of magnets are positioned adjacent each other. The alignment between opposite poles creates attractive forces between magnets of the first set 30 and magnets of the second set 40 to releasably hold the longitudinal edge portions 14, 15 in overlapping engagement with each other and maintain the tubular configuration of the body 13. Thus, the magnetic north pole of a magnet 31 in the first set 30 is aligned with the magnetic south pole of a magnet 41 in the second set 40 creating attractive instead of repulsive forces therebetween.

Once the protective cover 10 is placed in surrounding relation to the firearm 12, and the longitudinal edge portions 14, 15 are overlapped and engaged with each other by the attractive forces exerted through the sets of magnets 30, 40, the terminal end portions 20, 25 then are drawn into closer engagement with the firearm 12. At terminal end portions 20, 25 the body 13 is folded upon itself to define hems 21, 26 forming envelopes thereat. Carried within each hem or envelope is a drawstring 22, 27. By pulling each drawstring 22, 27, terminal end portions 20, 25 are drawn into closer engagement with the firearm 12 minimizing sliding of the protective cover 10 relative to the firearm 12. Once the drawstrings 22, 27 are taut, they are tied into releasable knots 23, 28.

It has been found that during hunting, the drawstrings 22, 27 should not be tightened and tied (FIG. 3). If game is quickly spotted, the additional time of untying and loosening a drawstring added to the time of removing the protective cover 10, sighting to the game and discharging the firearm 12 may create a time frame in which the game already has fled out of range. The drawstring is best utilized when the firearm 12 is stored or carried from one hunting area to another.

Once the drawstrings 22, 27 are loosened and untied, the protective cover 10 is removed readily from the firearm 12. With the firearm 12 held under an armpit, the hunter grasps one longitudinal edge portion of the cover with one hand and the other longitudinal edge portion with the other hand and both edge portions 14, 15 are slid relative to each other in opposite directions. Since the spacing between each of the magnets 31, 41 is greater than the length of the magnets, as the longitudinal edge portions 14, 15 are slid relative to each other, the magnets 31, 41 of the first set 30 no longer lie adjacent magnets of the second set 40. Instead, each magnet of each set 30, 40 lies adjacent a part of the opposing hem which does not contain a magnet therein. At this point, the attractive forces between the magnets of the first set 30 and the magnets of the second set 40 are minimized and the protective cover 10 is removed. The total time to remove the cover 10 should take no more than a few seconds giving the hunter ample time to sight toward the game and discharge the firearm 12. In addition, removal is silent and effortless minimizing the chance that game may become alarmed.

Since the protective cover 10 is large enough to cover entirely the telescopic sight and bolt mechanism 11 of a firearm 12, the protective cover 10 also is large enough to double as a ground cloth. Often, hunters must sit on damp or otherwise uncomfortable ground and wait until game approaches their position. This not only is bothersome and uncomfortable, but it also may detract the hunter's attention making the success of a hunt less likely. Fortunately, a hunter easily can solve this problem by removing the protective cover 10 from the firearm 12 and placing it flatwise upon the earth. Since the protective cover 10 preferably is water-resistant, it doubles as a comfortable ground cloth.

The foregoing embodiment is to be considered illustrative rather than restrictive of the invention and those modifications which came within the meaning and range of equivalents of the claims are to be included therein.

That which is claimed is:

1. A detachable cover for protecting a firearm comprising a pliant elongate body having a first and second longitudinal edge portions adapted to be arranged in overlapping substantially aligned relation to each other so that said body is of tubular configuration, said body having opposed terminal end portions and being dimensioned and adapted for being placed in surrounding relation to the telescopic sight and bolt mechanism of a firearm, and spaced-apart magnetic means positioned along said longitudinal edge portions for providing forces attracting edge portions toward each other and for releasably holding the edge portions in overlapping engagement with each other so as to maintain the tubular configuration of the body.

2. The detachable cover as claimed in claim 1 including drawing means carried by said terminal end portions and adapted for drawing the terminal end portions into closer engagement with the firearm.

3. A detachable cover for protecting a firearm comprising a pliant elongate body having a first and second longitudinal edge portions adapted to be arranged in overlapping substantially aligned relation to each other so that said body is of tubular configuration, said body having opposed terminal end portions and being dimensioned and adapted for being placed in surrounding relation to the telescopic sight and bolt mechanism of a firearm, a first set of elongate magnets positioned in spaced-apart relation along the first longitudinal edge portion and a second corresponding set of elongate magnets positioned in spaced-apart relation along the second longitudinal edge portion with the distance between adjacent magnets of each set being greater than the elongate length of each adjacent magnet and wherein both sets of magnets are positioned so that when longitudinal edge portions are arranged in overlapping relation to each other, opposite magnetic poles from respective first and second sets of magnets are positioned adjacent each other to create attractive forces between magnets of the first set and magnet of the second set for releasably holding the longitudinal edge portions in overlapping engagement with each other so as to maintain the tubular configuration of the body.

4. The detachable cover as claimed in claim 3 including means carried by said terminal end portions and adapted for drawing the terminal end portions into closer engagement with the firearm.

5. A detachable cover for protecting a firearm comprising a pliant elongate body having first and second longitudinal edge portions adapted to be arranged in overlapping substantially aligned relation to each other so that said body is of tubular configuration, said body being folded upon itself at longitudinal edge portions to define a hem thereat, said body having opposed terminal end portions and being dimensioned and adapted for being placed in surrounding relation to the telescopic sight and bolt mechanism of a firearm, a first set of elongate magnets positioned in spaced-apart relation within the hem of said first longitudinal edge portion and a second corresponding set of elongate magnets positioned in spaced-apart relation within the hem of the second longitudinal edge portion with the distance between adjacent magnets of each set being greater than the elongate length of the magnets and wherein both sets of magnets are positioned so that when longitudinal edge portions are arranged in overlapping relation to each other, opposite magnetic poles from respective first and second sets of magnets are positioned adjacent each other to create attractive forces between magnets of the first set and magnets of the second set for releasably holding the longitudinal edge portions in overlapping engagement with each other so as to maintain the tubular configuration of the body.

6. The detachable cover as claimed in claim 5 wherein said body is folded upon itself at terminal end portions to define a hem thereat, and including a drawstring carried within each hem at each terminal end portion for drawing the terminal end portions into closer engagement with the firearm.

* * * * *